313-422 SR
2/16/82 OR 4,316,117

United States Patent [19]
Carroll

[11] 4,316,117
[45] Feb. 16, 1982

[54] BASEPLATE ASSEMBLY FOR FLAT PANEL DISPLAY DEVICES

[75] Inventor: Charles B. Carroll, Trenton, N.J.

[73] Assignee: RCA Corporation, New York, N.Y.

[21] Appl. No.: 116,251

[22] Filed: Jan. 28, 1980

[51] Int. Cl.[3] ..... H01J 29/72; H01J 29/02
[52] U.S. Cl. ..... 313/422; 313/432; 313/417
[58] Field of Search ..... 313/422, 417, 409, 432, 313/444

[56] References Cited

U.S. PATENT DOCUMENTS 4,028,582 6/1977 Anderson et al. ..... 313/422
4,099,087 7/1978 Peters ..... 313/422

*Primary Examiner*—Eli Lieberman
*Attorney, Agent, or Firm*—Eugene M. Whitacre; Glenn H. Bruestle; Lester L. Hallacher

[57] ABSTRACT

A flat panel display device includes a baseplate assembly which can be readily fabricated using mass production techniques. An insulative modulator support member is affixed to the baseplate in a location accurately defined with respect to location notches in the baseplate. A distal mesh support is accuratey located and maintained with respect to the location notches in a transverse direction and is loosely held in a longitudinal direction. The modulator support member and the distal mesh support contain slots which loosely receive vanes while holding the vanes perpendicular to the baseplate. The vanes thus form channels which extend longitudinally along the baseplate and perpendicular to the modulator support. The modulator support contains a recess extending transversely across the baseplate and a plurality of longitudinally extending recesses positioned in the proximity of the center of the channels. Tabs on beam guide assemblies engage the recesses to maintain precise spacing between the beam guide assemblies and modulator support. Tabs on the distal ends of the beam guide assemblies engage recesses in the distal mesh support. Grooves in the vanes receive beads which couple the meshes forming the beam guide assemblies. Upon evacuation of the envelope formed by mating the baseplate assembly with a front wall and side walls atmospheric pressure retains the assembly in the desired orientation and the vanes support the baseplate and front wall against collapse.

8 Claims, 3 Drawing Figures

BASEPLATE ASSEMBLY FOR FLAT PANEL DISPLAY DEVICES

BACKGROUND OF THE INVENTION

This invention relates generally to flat panel display devices and particularly to a baseplate assembly for such devices.

U.S. Pat. No. 4,028,582 discloses a flat panel display device in which a backplate and a faceplate are spaced in parallel planes. A plurality of vanes extend between the backplate and faceplate to divide the envelope into a plurality of channels and also to support the faceplate and backplate against atmospheric pressure after the envelope is evacuated. Arranged in each of the channels is a pair of beam guides which extend longitudinally along the channels and transversely across the channels. The beam guides are parallel and spaced apart and serve as guides along which electron beams are propagated the lengths of the channels.

The inside surface of the faceplate is provided with a phosphor screen which luminesces when struck by electrons. A plurality of extraction electrodes are arranged along the baseplate and are used to eject the electron beams from between the beam guides to direct the electrons toward the phosphor screen. Deflection electrodes are provided on the sides of the support vanes and are electrically energized to cause the electrons to transversely scan across the channels. Accordingly, each of the channels contributes a portion of the total visual display of the device. The display device described in this patent is disadvantageous because mass production and automatic assembly techniques cannot be used in producing the device.

U.S. Pat. No. 4,099,087 discloses a flat panel display of the type described above which includes a plurality of spacer members along the backwall parallel to the vanes. Each of the spacer members has a ledge projecting into an adjacent channel and spaced from the backwall. Within each of the channels is a beam guide assembly which includes a pair of spaced guide meshes. One of the meshes has spring tabs spaced along one edge which fit under the ledges of the spacer members to hold the assembly in a fixed position with respect to the backwall. The other mesh has location tabs spaced along one edge to engage the spacer members and align the beam guide assembly in the channels with respect to the support walls. This display device also is disadvantageous because mass production and automatic assembly techniques cannot be used in producing the device.

Copending application Ser. No. 966,564 filed Dec. 4, 1978 by Charles H. Anderson, et al., now U.S. Pat. No. 4,199,705, entitled "Modulator Structure For A Flat Panel Display Device" discloses a modulator structure having pairs of modulation electrodes partially overlapping beam guide assemblies. A modulator member includes two substantially flat parallel surfaces which are connected by a curved portion. A smooth continuous electrode is arranged on the flat surfaces and the curved portion. Modulation electrodes are arranged on the inside surface of the baseplate. The modulator member is applied to the baseplate so that there is electrical contact between the electrodes on the modulator member and the electrodes on the baseplate. This modulator structure can be used in the display device described in the instant application.

SUMMARY OF THE INVENTION

In a flat panel display device, a baseplate assembly includes a modulator support block and a distal support block. Slots are provided in both blocks to loosely support vanes which divide the display into longitudinal channels. The slots hold the vanes normal to the surface of the baseplate. The vane support blocks also include retention recesses. Beam guide assemblies are arranged in the channels to propagate electrons along the lengths of the channels. The beam guide assemblies include retention tabs which mate with the retention recesses to longitudinally and transversely position the beam guide assemblies. Distal recesses in the distal support block receive the distal tabs on the beam guide assemblies to transversely retain the beam guides while allowing longitudinal motion caused by thermal expansion of the beam guide assemblies. Proximal retention tabs mate with proximal recesses in the modulator support block to transversely and longitudinally retain the proximal ends of the beam guide assemblies. The beam guide assemblies are held together by insulative beads. Notches in the vanes receive the beads and springs bias the beam guide assemblies against the surface of the backplate.

DETAILED DESCRIPTION OF THE PREFERRED EMBODIMENT

Figure 1:
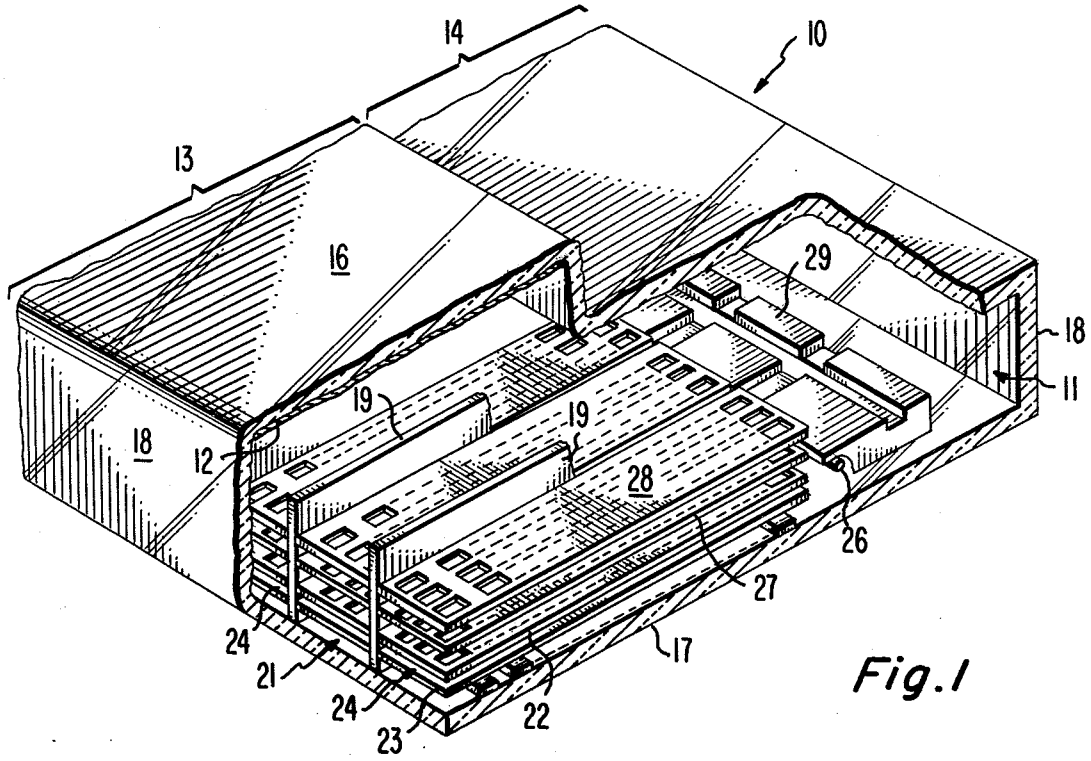
FIG. 1 is a simplified perspective view, partially broken away, showing the major components of a flat panel display device incorporating the preferred embodiment.

FIG. 1 shows a flat panel display device 10 which incorporates the preferred embodiment. The display device 10 includes an evacuated envelope 11 having a display section 13 and an electron gun section 14. The envelope 11 includes a frontwall 16 and a baseplate 17 in spaced parallel relationship with the frontwall 16. The frontwall 16 and the baseplate 17 are connected by four sidewalls 18. A display screen 12 is positioned along the front wall 16 and gives a visual output when struck by electrons.

A plurality of spaced parallel support vanes 19 are secured between the front wall 16 and the baseplate 17. The support vanes 19 provide the desired internal support against external atmospheric pressure and divide the envelope 11 into a plurality of channels 21. Each of the channels 21 encloses a pair of spaced parallel beam guide meshes 22 and 23 extending transversely across the channels and longitudinally along the channels from the gun section 14 to the opposite side wall 18. A cathode 26 is arranged to emit electrons into the spaces 24 between the guide mesh pairs so that the electrons propagate the lengths of the channels. A focus mesh 27 and an acceleration mesh 28 are arranged between the beam guide 22 and the display screen 12. A modulator support 29 extends the transverse dimension of the envelope 11 and retains the meshes 22, 23, 27 and 28 against longitudinal and transverse movement with respect to the modulator support and the cathode 26.

Figure 2:
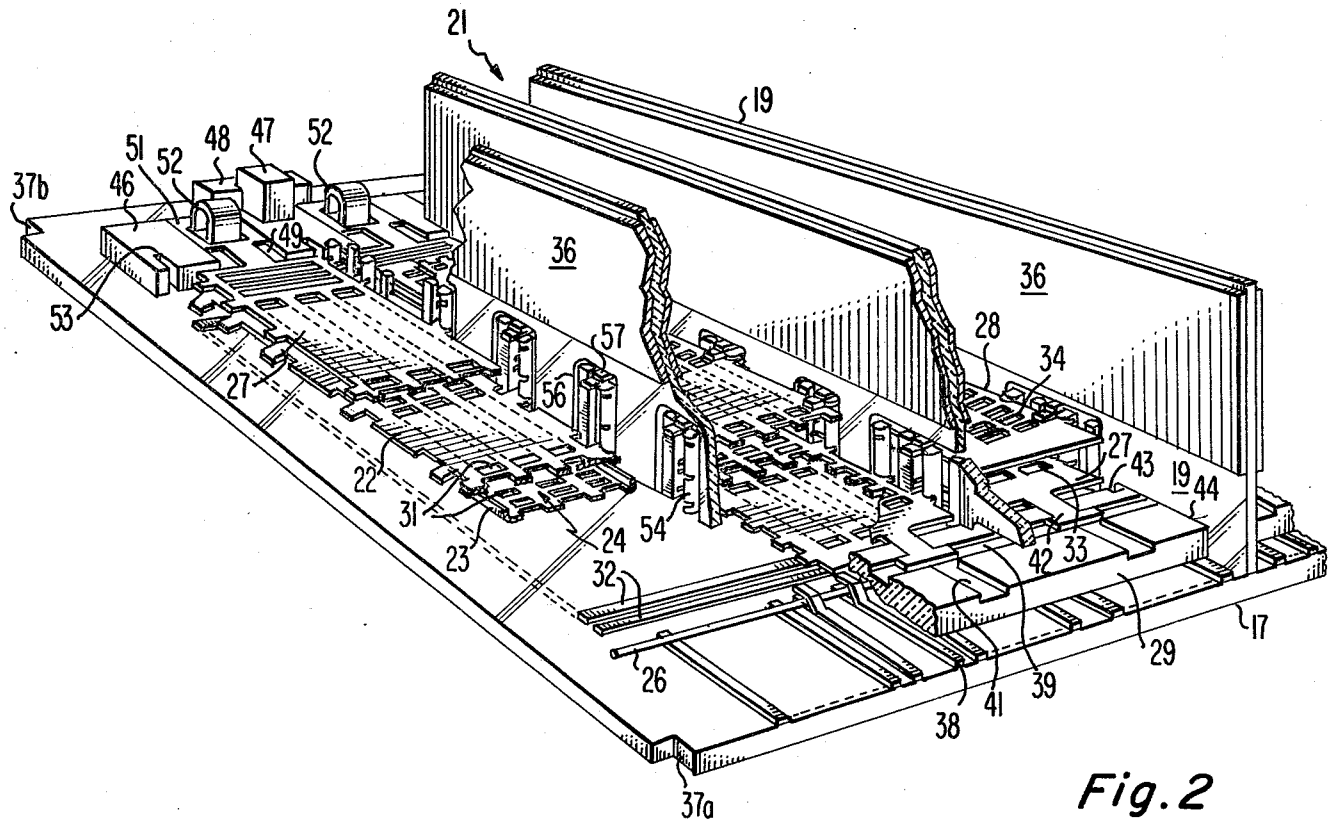
FIG. 2 is a perspective view, partially broken away, of a preferred embodiment of the novel display device.

FIG. 2 shows the preferred embodiment of FIG. 1 with the front wall 16 and side walls 18 removed. The beam guide meshes 22 and 23 contain apertures 31 which are arranged in columns longitudinally along the channels 21 and in rows transversely across the channels. Extraction electrodes 32 are arranged along the inside surface of the baseplate 17 and extend across the entire transverse dimension of the baseplate. Each extraction electrode 32 is aligned with one of the transverse rows of apertures 31 in the guide meshes 22 and 23 so that energization of one extraction electrode results in the generation of one line of the display.

The focus mesh 27 is spaced from and parallel to the upper guide mesh 22, and the acceleration mesh 28 is spaced from and parallel to the focus mesh 27. The focus mesh and the acceleration mesh, respectively, contain apertures 33 and 34, which are transversely aligned with the apertures 31 within the guide meshes 22 and 23. The transverse rows of apertures in the meshes 22, 27 and 28 are slightly displaced longitudinally so that the rows of apertures lie along the curved paths followed by the electrons which are ejected from the spaces 24.

The cathode 26 is positioned to emit electrons into the space 24 between the guide meshes 22 and 23. Each of the longitudinal columns of apertures 31 serves as an electron beam guide so that three electron beams propagate the lengths of the channels 21. Appropriate biasing potentials are applied to the extraction electrodes 32 and the focus electrode 27 to create electrostatic fields which penetrate the apertures 31 and focus the electron beams in the spaces 24 between the guide meshes 22 and 23. When it is desired to extract the electron beams from between the guide meshes, a negative potential is applied to one of the extraction electrodes. This potential deflects the electron beams through the same transverse row of apertures 31 in all of the channels 21. The electrons pass through the apertures 34 and 33 in the acceleration mesh and focus mesh respectively, and travel toward the display screen 12. Deflection electrodes 36 on both sides of the vanes 19 are biased with variable deflection voltages to cause the electrons travelling toward the display screen 12 to be scanned transversely across the channels. In this manner the electron beams are simultaneously transversely scanned across all the channels resulting in one complete line of the visual display across the face of the display screen 12.

The line cathode 26 provides electrons for all of the channels 21. Additionally, one complete line of the visual display is generated by the passage of electrons through the same transverse row of apertures 31 in all the guide mesh pairs. Accordingly, it is essential that the guide mesh assemblies of all of the channels 21 be properly aligned with respect to the cathode 26. This is accomplished by the utilization of the modulator support 29. The modulator support 29 is fabricated from glass or other non-conductive material and extends transversely across the display device perpendicular to the channels 21. Two reference notches 37*a* and 37*b* are provided in two corners of the baseplate 17, and the modulator support 29 is accurately positioned and aligned with respect to these reference notches. The modulator support is fritted, or otherwise permanently affixed, to the internal surface of the baseplate 17. Prior to the application of the modulator support 29 to the baseplate 17, modulation electrodes 38 are applied in the manner fully described in the application Ser. No. 966,564.

The modulator support 29 is provided with a longitudinal retention recess 39 which runs the entire length of the support. A plurality of transverse retention recesses 41 is arranged perpendicular to the longitudinal recess 39 and are centered at the center line of each of the channels 21. The recesses 39 and 41 have a depth which is greater than the thickness of T-shaped retention tabs 42 formed on the proximal end of each of the focus meshes 27. The mating of the T-shaped tabs 42 with the recesses 39 and 41 maintains the transverse and longitudinal positions of the proximal ends of the guide meshes with respect to the modulator support 29 and the cathode 26 to retain accurate alignment of the guide mesh assemblies with respect to the modulator support and the cathode.

Rectangular vane support slots 43 having a width slightly larger than the thickness of the vanes 19 and a depth extending to the baseplate 17 are spaced along the length of the modulator support 29. These notches loosely receive the vanes and maintain the vanes in an orientation which is perpendicular to the face of the baseplate 17. The vanes 19 contain notches 44 having a length sufficient to allow the vanes to span the width of the modulator support 29 and a depth which causes the bottoms of the vanes to be pressed against the surface of the baseplate 17 by atmospheric pressure acting against the front wall 16 and the baseplate 17 when the envelope is evacuated. The vanes 19, therefore, are readily inserted into the slots 43 while being held in a perpendicular orientation with respect to the baseplate 17.

Figure 3:
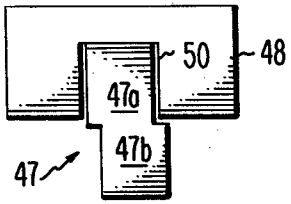
FIG. 3 is a detail showing of the means for precisely locating and focusing the distal support into a transverse position.

A distal mesh support 46, which extends transversely across the display device perpendicular to the channels 21, is provided at the distal end of the channels 21. The distal mesh support is fabricated from a non-conductive material, such as glass, and mates with a locating key 47 which mates with a locking block 48. As shown in FIG. 3 the locking block 48 includes a rectangular groove 50 which opens toward the channels 21. The locking block 48 is accurately positioned with respect to the reference notches 37*a* and 37*b*, and is permanently affixed to the baseplate 17 by a convenient means, such as fritting. A positional accuracy of 0.0025 cm is adequate for the locating block position. The locating key 47 includes two rectangular portions 47*a* and 47*b*. The portion 47*a* is dimensioned to clearly mate with the groove 50 of the locking block. The portion 47*b* is dimensioned to mate with a groove in the distal support 46. The portion 47*b* is offset from the portion 47*a* to cause the distal support 46 to be precisely positioned transversely with respect to the reference notches 37*a* and 37*b*. Thus, after the locking block 48 is fritted to the baseplate 17 the exact transverse position with respect to the reference notches is measured and recorded. Exact transverse positioning of the distal support 46 can be obtained offsetting the portions 47*a* and 47*b* of the locating key 47 by a distance equal and a direction opposite to the measured positional inaccuracy of the locking block 48. The transverse position of the beam guide assemblies is thereby precisely established by fritting one small element to the baseplate 17. Stresses in the baseplate therefore are minimized by the use of the locking block 48 and locating key 47. The locating key 47 and the locking block 48 retain the transverse position of the distal mesh support 46 so that the support cannot move in a direction perpendicular to the longitudinal axes of the channels 21; however, the mesh support 46 is free to move in a direction which is parallel to the longitudinal axes of the channels 21. A distal retention recess 49 is provided in the distal mesh support 46 to receive a distal retention tab 51 provided on the distal end of the focus mesh 27. The width of the recess 49 is chosen to prevent transverse motion of the tab 51 within the recess. Accordingly, both ends of the guide mesh assemblies are held in a permanent transverse position and the proximal end is held in a permanent longitudinal position with respect to the modulator support 29 and the cathode 26. A U-shaped leaf spring 52 applies longitudinal tension to the focus mesh 27 so that the T-shaped tab 42 in the proximal end of the mesh assembly is biased against the front of the recess 39. However, the longitudinal freedom of motion of the distal ends of the guide assemblies and the tension provided by the spring 52 permit any longitudinal movement which may be occasioned by thermal expansion of the guide mesh assemblies.

The distal mesh support 46 includes slots 53 having a width sufficient to receive the vanes 19 spaced along the length of the support. The vanes fit loosely within the slots 53 and are maintained in a position normal to the baseplate 17 in the same manner as the slots 43 in the modulator support 29. Accordingly, the vanes 19 are loosely held within the slots but are maintained in a position perpendicular to the plane of the baseplate 17. The leaf spring 52 biases the support 46 toward the modulator support 29. Accordingly, the sides of the slots 43 and 53 push against the edges of the vanes 36 to snugly hold the vanes and guide mesh assemblies together.

The two guide meshes 22 and 23, the focus mesh 27 and the acceleration mesh 28, which compose each of the guide mesh assemblies, are held together by insulative support members, such as beads 54, which permanently retain the four meshes in a parallel orientation with respect to each other and to the baseplate 17.

The vanes 19 contain a plurality of grooves 56 to receive the beads 54 of the mesh assemblies. The beads 54 are spaced along both sides of the mesh assemblies and the beads on opposite sides are staggered so that each of the grooves 56 receive a bead from the guide mesh assemblies in adjacent channels. Biasing means, such as springs 57, are arranged between the beads 54 and the tops of the slots 56 to resiliently bias the beads of the mesh assemblies against the surface of the baseplate 17. The slots 56 are longitudinally dimensioned to permit movement of the beads in a direction parallel to the lengths of the channels 21 in response to thermal expansion of the mesh assemblies.

In assembling the novel baseplate assembly the modulator support 29 is longitudinally and transversely precisely positioned with respect to the notches 37*a* and 37*b* and fritted to the internal surface of the baseplate 17. The locating block 48 is approximately positioned transversely with respect to the notches 37*a* and 37*b* and fritted to the baseplate 17. The distal support 46 is transversely positioned with respect to the reference notches 37*a* and 37*b* and locked by the locking block 48 with the key 47. The precise transverse position of the support 46 is obtained by the offset between the portions 47*a* and 47*b* of the key 47. The slots 43 and 53, which support the vanes 19, and the recesses 41 and 49, which engage the retention tabs 42 and 51, are longitudinally aligned and the channels 21 are perpendicular to the modulator support 29. The guide mesh assemblies are then applied to the baseplate simply by placing the retention tabs 42 and 51 into the retention recesses 41 and 49 respectively. The vanes 19 are then inserted into the slots 43 and 53 in the modulator support 29 and the distal support 46 respectively and are held perpendicular to the baseplate 17 by the slots. The tension springs 52 are then inserted into the tabs to put longitudinal tension on the beam guide assemblies. This tension causes the slots 53 to push against the distal ends of the vanes 19 and thereby cause the sides of the grooves 44 to push against the slots 43 in the modulator support 29. The tension of the springs 52 thus holds the beam guide assemblies, the vanes and the distal support in place with respect to the modulator support 29.

The sidewalls 18 and the front wall 16 are then applied to the baseplate assembly and upon evacuation of the envelope atmospheric pressure acting on the external surfaces tightly holds the assembled members in a unitary assembly while the vanes 19 support the front wall 16 and baseplate 17 against fracture by atmospheric pressure.

What is claimed is:

1. In a flat panel display device having an evacuated envelope divided into channels by a plurality of vanes and including a front wall and a baseplate arranged substantially parallel and connected by side walls, an improved baseplate assembly comprising:

a plurality of reference notches in said baseplate;

a modulator support accurately affixed to said baseplate with respect to said reference notches and extending transversely across said baseplate substantially perpendicular to said channels and located at the proximal ends of said channels;

a plurality of beam guide assemblies arranged in said channels for propagating electron beams longitudinally along said channels, said beam guide assemblies including proximal retention tabs and distal retention tabs;

beam guide proximal retention recesses arranged in said modulator support for engaging said proximal retention tabs to prohibit longitudinal and transverse motion of the proximal ends of said beam guide assemblies with respect to said modulator support;

proximal vane support slots spaced along the length of said modulator support for loosely receiving said vanes and holding said vanes substantially perpendicular to said baseplate;

distal guide support means positioned along the distal ends of said channels and substantially parallel to said modulator support, said distal guide support including distal retention recesses for engaging said distal retention tabs to retain the transverse location of said beam guide assemblies with respect to said reference notches;

distal vane support slots spaced along the length of said distal guide support means and aligned with said proximal support slots for loosely receiving said vanes and holding said vanes substantially perpendicular to said baseplate.

2. The display device of claim 1 wherein said distal support means is accurately located and retained transversely with respect to said reference notches.

3. The display device of claim 2 further including a locating key accurately located transversely with respect to said reference notches, said distal guide support means being configured to engage said key for transversely locating said distal guide support.

4. The display device of claim 3 wherein said distal retention tabs are longitudinally slidably held in said distal recesses; and further including biasing means for maintaining longitudinal tension on said beam guide assemblies during longitudinal motion in response to thermal dimension changes.

5. The display device of claim 4 wherein said beam guide assemblies include a plurality of parallel guide meshes, said guide meshes being held in a stacked and spaced relationship by insulative support members.

6. The flat panel display device of claim 5 wherein said vanes include grooves, said grooves receiving said insulative support members and biasing said support members against said baseplate.

7. The display device of claim 6 further including biasing means arranged between said support members and said grooves to resiliently bias said support members to said baseplate.

8. The display device of claim 3 wherein said vanes include notches at the proximal end, said notches being dimensioned to span said modulator support so that said grooves rest against said modulator support; and further including biasing means for maintaining longitudinal tension on said beam guide assemblies and for biasing said distal guide support, said vanes and said modulator support together.

* * * * *